United States Patent [19]

Gurgui

[11] Patent Number: 4,709,892

[45] Date of Patent: Dec. 1, 1987

[54] ADJUSTABLE SUPPORT FOR BOOKSHELVES

[76] Inventor: Merce B. Gurgui, C. Consell de Cent, 83, 08015 Barcelona, Spain

[21] Appl. No.: 883,702

[22] Filed: Jul. 9, 1986

[30] Foreign Application Priority Data

Jul. 11, 1985 [ES] Spain ..... 288.009

[51] Int. Cl.[4] ..... A47B 57/04

[52] U.S. Cl. ..... 248/250; 248/242; 108/152

[58] Field of Search ..... 248/250, 235, 242, 241, 248/231.4, 295.1; 108/152; 211/153, 134, 150

[56] References Cited

U.S. PATENT DOCUMENTS

| | | | |
|---|---|---|---|
| 883,323 | 3/1908 | Macduff | 248/250 |
| 4,429,850 | 2/1984 | Weber et al. | 248/250 |

FOREIGN PATENT DOCUMENTS

| | | | |
|---|---|---|---|
| 1237682 | 6/1960 | France | 211/134 |
| 442787 | 3/1927 | Netherlands | 248/250 |
| 618669 | 2/1949 | United Kingdom | 248/235 |
| 823512 | 11/1959 | United Kingdom | 248/250 |
| 1197051 | 7/1970 | United Kingdom | 248/242 |

OTHER PUBLICATIONS

PX Industries, Inc., "Snap In Shelf Stay".

*Primary Examiner*—Ramon S. Britts
*Assistant Examiner*—Karen J. Chotkowski
*Attorney, Agent, or Firm*—Steinberg & Raskin

[57] ABSTRACT

An adjustable support for a bookshelf of varying thickness, comprising a first clamping member having a first clamping surface, and a second clamping member having a second clamping surface. The first clamping member is adapted to be affixed to a stationary support, and has a passageway through which a threaded member is rotatably mounted. The second clamping member is threadedly connected to the threaded member, so that rotation of the threaded member varies the spacing between the first and second clamping surfaces.

14 Claims, 3 Drawing Figures

FIG. 1
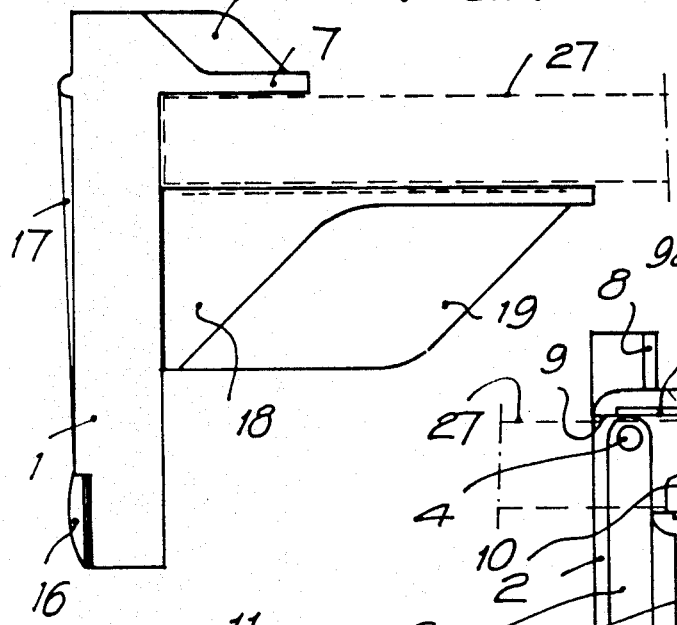
FIG. 3
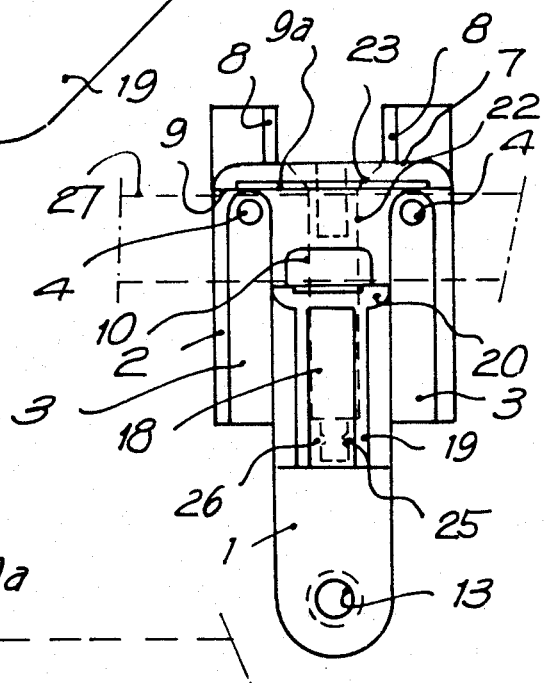
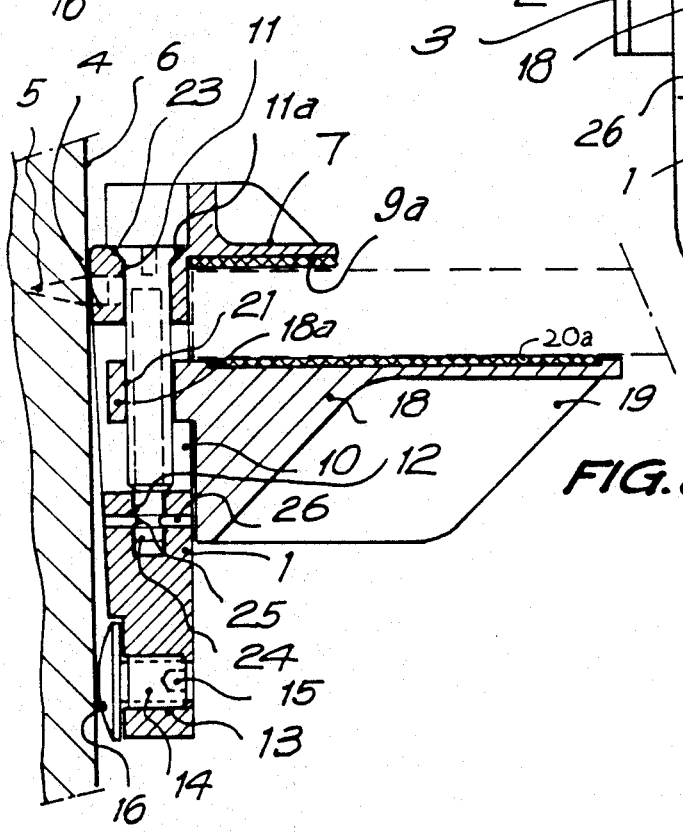
FIG. 2

ADJUSTABLE SUPPORT FOR BOOKSHELVES

BACKGROUND OF THE INVENTION

The present invention relates to an adjustable support or clamp for bookshelves of simple and practical construction.

Bookshelf supports presently exist in which apertures are provided for the passage of screws, which pass through or across the bookshelf itself. However, such units are not practical, because the apertures are forced upon some part of the surface of the bookshelf itself.

Other units are known, in which the support has the configuration of a stationary clamp. However, these particular devices have the disadvantage in that each support can be used only with a bookshelf of predetermined thickness. Thus, there is a need for a type of support which can accommodate a bookshelf of any particular thickness (the present invention is directed to just such a bookshelf support).

Adjustable supports for bookshelves are known, in which displacement of the control jaw is carried out in a notched escalating manner. However, the possibilities of application of such an adjustable support are also limited to bookshelves or boards having a pre-determined thickness. There is no possibility of using such devices to support or clamp boards or bookshelves of intermediate varying thicknesses.

SUMMARY OF THE INVENTION

Accordingly, it is an object of the present invention to provide an adjustable clamp or support for a bookshelf.

It is also an object of the present invention to provide a simple and practical clamp or support for a bookshelf.

It is another object of the present invention to provide a more versatile clamp or support for a bookshelf.

It is a further object of the present invention to provide for the clamping or support of a bookshelf of any particular thickness which need not be predetermined.

Accordingly, the present invention eliminates the disadvantages or drawbacks noted above, and is directed to an adjustable support for a bookshelf, which is simple and practical, and can be applied to support bookshelves of different varying thicknesses.

These and other objects are attained by the present invention which is directed to an adjustable support for a bookshelf, comprising a first clamping member having a first clamping surface, and means for fixing the first clamping member to a stationary support. The first clamping member comprises a passageway, with a threaded member being rotatably mounted in the first clamping member. The threaded member includes a portion which extends into the passageway. A second clamping member is coupled to the first clamping member, and has a second clamping surface in spaced opposed relationship to the first clamping surface. The second clamping member is threadedly connected to the threaded member, so that rotation of the threaded member varies the spacing between the first and second clamping surfaces.

In the support or clamp of the present invention, a single piece, for example formed of injected aluminum, forms the stationary clamping member. In other words, this single piece which constitutes a stationary clamp, has a portion which projects out frontally with respect to a backing designed to seat against a vertical surface of a wall. A groove or opening, constituting a passageway, is situated substantially vertically through this stationary piece when it is mounted upon a wall, and constitutes a central guide for the vertical displacement of a second mobile or adjustable clamping member.

This second clamping member is advantageously formed as a single body too, e.g. of injected aluminum, and is complementary to the stationary clamp. Both the adjustable and stationary clamp members have substantially aligned apertures, with the aperture formed in the movable clamping member being at least partially threaded. This at least partially threaded hole receives a screw or threaded member having an action head. The rotation of this screw or threaded member controls displacement of the vertically-adjustable clamping member with respect to the stationary member.

The stationary piece constituting the backing or mounting of the entire support or clamp, is also provided with a threaded opening situated in an extreme lower region thereof when the clamp is mounted on a wall. A screw is twisted into this opening, the screw having a frontal end configured for adjustment of the same, and a rear edge which expands to form a head for smooth support against the vertical surface or wall upon which the stationary support is seated.

The rear surface of the backing or mounting comprises a projection adjacent the upper part thereof, which progressively diminishes downwardly, as in the manner of a ramp.

The stationary clamping support is advantageously provided on the rear thereof, with reinforced flaps, forming a single body or piece with the remainder of the stationary clamp. Such reinforced flaps protrude on the lateral sides or edges of the device.

Preferably, the backing or mounting faces a vertical "window" or opening on the movable clamping member, so that the movable member can be guided from the rear. At the top of this "window" or opening, the backing or mounting faces an opening provided in the stationary member, in which the head of the screw or threaded member remains lodged. A rear portion of the movable clamping member, which also protrudes outwardly, is provided with an opening which is threaded, and in which the threaded member can be turned. There is a small blind opening provided at the extreme lower portion of this "window", in which the end of the threaded member or screw remains anchored. The screw or threaded member is provided with a neck which can be deeply impressed into this blind opening at the lower end of the backing or mounting, thus immobilizing the screw against axial movement.

The surface of the clamp itself, is advantageously provided with a sheet-like shock absorber which is slip-proof.

The protruding portion of the stationary clamping member, is also preferably provided, at the top thereof, with at least one reinforcing wing also formed together with the stationary member as a single piece. The clamping surface of the stationary member also comprises ridges along the edges thereof extending longitudinally away from the backing or mounting as illustrated. The shock absorbing rubber plate is preferably situated between these ridges or edges.

By the same token, the adjustable clamping member is preferably provided with at least one reinforcing wing at the bottom thereof, and in the form of a metal piece. The clamping surface of the adjustable clamping member also has ridged edges, between which a rubber shock absorber may be situated.

BRIEF DESCRIPTION OF THE DRAWINGS

The present invention will now be described in greater detail, with reference to a preferred embodiment illustrated in the accompanying drawings, in which FIG. 1 is a side elevational view of a support or clamp in accordance with the present invention, FIG. 2 is a longitudinal sectional view of the support or clamp, and FIG. 3 is a front elevational view of the support or clamp.

DESCRIPTION OF THE PREFERRED EMBODIMENT

In the adjustable support for a bookshelf in accordance with the present invention, a unitary backing or mounting 1, which widens at the outer lateral edges 2 thereof, is provided with frontal grooves 3, along with openings 4 for the passage of anchoring screws 5 for fixing the stationary support 1 to a wall 6.

In the upper portion of the piece 1, the stationary clamp frontally extends outwardly 7, with reinforcements 8 on the upper portion thereof. The clamping surface also protrudes out laterally 9, with a shock absorber 9*a* of rubber or similar material being situated between the protruding lateral edges 9.

The piece 1 is also provided with an extended opening 10 or passageway, which extends in a vertical direction when the clamp is mounted upon a wall 6. The upper portion of the extended opening 10 leads into another opening 11, while a blind opening 12 is provided in the lower end of the stationary member, and is substantially aligned with the upper opening 11.

A threaded opening 13 is also provided proximate to the extreme lower end of the stationary piece 1. A screw 14 is inserted within this threaded opening 13, and is provided with a cavity 15 which is accessible by an appropriate tool. This screw 14 also has a rear head 16 which is designed to abut against the wall 6. Thus, this screw 14 is adjustable against the vertical portion of the support, and constitutes means for levelling the same by appropriate adjustment.

The rear of the stationary mounting 1 preferably comprises longitudinal ridges or edges 17 which decrease in the direction towards the bottom of the support 1, as illustrated.

A movable clamping member 18 which is provided with respect to the support 1, is in the form of a small metallic piece having wings 19 along the bottom thereof, along with longitudinal reinforcing ridges 20 on the edges of the clamping surface as illustrated. A shock-absorbing plate 20*a* of rubber or similar material is situated on the clamping surface between these ridges or edges 20 as illustrated.

The movable clamp 18 is also formed as a single piece of injected aluminum, in the same manner as the stationary mounting 1. The movable or adjustable clamping member 18 has a portion 18*a* which protrudes rearwardly and has an opening 21 through which the screw 22 passes. Thus, this portion 18*a* of the movable clamping member 18 is adjustable along the longitudinally extending passage 10 of the stationary support 1 (i.e. is adjustable with respect to the stationary support 1 itself). Accordingly, guiding of displacement of the vertical clamp, i.e. the adjustable clamping member 18, is provided.

As noted above, the protruding portion 18*a* of the clamping member 18, is provided with a threaded opening 21, which extends in the vertical direction when mounted upon the screw 22, and through which the screw 22 can be turned. The head 23 of the screw 22 remains lodged or anchored in the opening 11 provided in the support 1. The extreme bottom 24 of the screw 22 is firmly anchored 25 in the blind opening 12 upon the stationary support 1.

In other words, the spindle 25 of the screw is lodged in the passageway 26, which impedes axial displacement of the screw 22, but permits turning or rotation of the same. The head 23 of the screw 22 has suitable configuration for coupling of a tool or special key to turn the same, and seats against an inclined edge 11*a* of the hole 11 as illustrated.

As can be easily seen from the drawings and the above description, the stationary support 1 is anchored on the wall 6 vertically, by screws 5, with the ridges 17 and the head 16 of the adjustable screw 44 abutting the wall. This allows for perfect adjustment of the vertical support 1 along the wall, in spite of any irregularities in the wall.

Furthermore, turning of the screw 22 by a special key or tool applied to the head 23 of the same, vertically displaces the movable clamp 18 with respect to the stationary clamp 7. In other words, rotation of the threaded member 22 varies the spacing between the first 9 and second 20 clamping surfaces. Therefore, a bookshelf 27 of any varying thickness may be accommodated by the clamp according to the present invention, and supported by the same. For example, the support of the present invention may suitably retain and support a bookshelf of 6 mm thickness, and 25 mm thickness, or any particular thickness therebetween without any limitation to finite values or thicknesses.

Thus, it is clear that the support according to the present invention provides distinct advantages over previously-used bookshelf supports. The support of the present invention ensures immobility of the shelf, which is fastened tightly between the clamping members. Furthermore, as clearly described above, the clamp of the present invention may be applied to different thicknesses of shelves, without regard to specific limitations of such thicknesses. This is all conveniently attained with a support essentially formed from separate bodies or pieces, each one molded into a single integral piece, and a screw or threaded member. Such pieces, as noted above, are suitably reinforced to assure resistance to stress, with a minimum amount of material.

The preceding description of the present invention is merely exemplary, and is not intended to limit the scope thereof in any way.

What is claimed is:

1. Adjustable support for a bookshelf, comprising a first clamping member having a first clamping surface, means for fixing said first clamping member to a stationary mounting, said first clamping member comprising a passageway, a threaded member rotatably mounted in said first clamping member and including a portion which extends into said passageway, and a second clamping member coupled to said first clamping member and having a second clamping surface in spaced opposed relationship to said first clamping surface, said second clamping member being threadedly mounted upon said threaded member, said threaded member comprising means for moving said second clamping surface towards or away from said first clamping surface upon rotation of said threaded member in one or another direction respectively, whereby rotation of said threaded member causes the spacing between said first and second clamping members to smoothly vary.

2. The support of claim 1, wherein said first clamping member comprises a first opening constituting a part of said passageway, and said second clamping member comprises a second opening threadedly receiving said threaded member, said first and second openings being substantially aligned.

3. The support of claim 1, wherein said first clamping member comprises a protruding portion upon which said first clamping surface is situated, with said first clamping surface being situated above said second clamping surface.

4. The support of claim 1, wherein said passageway constitutes guide means for smooth displacment of said second clamping member with respect to said first clamping member.

5. The support of claim 1, wherein a rear surface of said first clamping member is inclined and constitute means for levelling said support.

6. The support of claim 5, wherein said rear surface of said first clamping member is inclined in a direction away from said fixing means.

7. The support of claim 6, wherein said levelling means additionally comprise a threaded aperture situated in a lower region of said first clamping member, and a screw situated in said threaded aperture having a head abutting against a wall of the stationary mounting.

8. The support of claim 1, wherein said fixing means comprise a hole in said first clamping member, and a nail, pin, bolt, or screw situated in said hole and extending into the stationary mounting in a direction substantially perpendicular to a direction said threaded member extends.

9. The support of claim 2, additionally comprising a third, blind opening situated in said first clamping member at an end thereof opposite said first opening and in which and end of said threaded member is seated, said third opening serving to anchor said threaded member while permitting rotation of the same.

10. The support of claim 1, wherein said passageway and threaded member extend substantially vertically.

11. The support of claim 1, wherein the threaded member is a screw

12. The support of claim 2, wherein said second opening extends substantially vertically.

13. The support of claim 5, wherein said rear surface being inclined towards a bottom of said first clamping member.

14. The support of claim 1, wherein a rear surface of said first clamping member comprises longitudinal ridges decreasing in a direction towards a bottom of said support.

* * * * *

UNITED STATES PATENT AND TRADEMARK OFFICE

CERTIFICATE OF CORRECTION

PATENT NO. : 4,709,892

DATED : December 1, 1987

INVENTOR(S) : Merce Bohigas Gurgui

It is certified that error appears in the above—identified patent and that said Letters Patent is hereby corrected as shown below: Title page:

(76) Inventor: MERCE BOHIGAS GURGUI, C. Concell de Cent, 83
08015 Barcelona, Spain

Signed and Sealed this

Seventeenth Day of April, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,709,892

DATED : December 1, 1987

INVENTOR(S) : Merce Bhigas Gurgui

It is certified that error appears in the above-identified patent and that said Letters Patent is hereby corrected as shown below:

On the title page, item [76] Inventor: should read

--MERCE BOHIGAS GURGUI, C. Consell de Cent, 83
08015 Barcelona, Spain--.

This certificate supersedes Certificate of Correction issued April 17, 1990.

Signed and Sealed this

Second Day of March, 1993

*Attest:*

STEPHEN G. KUNIN

*Attesting Officer*

*Acting Commissioner of Patents and Trademarks*